United States Patent [19]

Chevalier et al.

[11] Patent Number: 4,724,787

[45] Date of Patent: Feb. 16, 1988

[54] DEVICE FOR FURLING A SAIL OF A SHIP ON A BOOM

[75] Inventors: Jean-Yves Chevalier, Ouistreham; Jean-Paul Pouligny, La Rochelle, both of France

[73] Assignee: Plastimo, Lorient, France

[21] Appl. No.: 905,999

[22] Filed: Sep. 11, 1986

[30] Foreign Application Priority Data

Sep. 11, 1985 [FR] France ..... 85 13485

[51] Int. Cl.[4] ..... B63H 9/10

[52] U.S. Cl. ..... 114/107; 114/104; 114/106

[58] Field of Search ..... 114/39, 111, 102–107

[56] References Cited

U.S. PATENT DOCUMENTS

| | | | |
|---|---|---|---|
| 2,197,654 | 4/1940 | Beaudry | 114/107 |
| 3,260,230 | 7/1966 | Kauart | 114/102 |
| 3,285,215 | 11/1966 | Potter | 114/102 |
| 3,648,511 | 9/1971 | Katshen | 114/106 |
| 3,749,042 | 7/1973 | Jackson | 114/107 |
| 3,877,406 | 4/1975 | Davis | 114/106 |
| 4,059,063 | 11/1977 | Hood | 114/106 |
| 4,269,134 | 5/1981 | Shapland | 114/107 |

FOREIGN PATENT DOCUMENTS

| | | | |
|---|---|---|---|
| 2295873 | 7/1976 | France | 114/107 |

*Primary Examiner*—Sherman D. Basinger
*Assistant Examiner*—Clifford T. Bartz
*Attorney, Agent, or Firm*—Sughrue, Mion, Zinn, Macpeak, and Seas

[57] ABSTRACT

This device for furling a sail of a ship on a boom (1) connected to a mast (2) by means of articulation means (3) and mounted so that it can rotate about itself, comprising means for driving the boom (1) in rotation (7) in order to furl the sail on the latter, is characterized in that the said means for driving in rotation (7) are arranged on the end of the boom (1) away from the articulation means (3). These driving means comprise a drum (8) integrally fastened to the boom (1), around which is arranged a line for driving (10) the said drum, this line being connected, for example, to the steering station of the ship by return means (11, 12).

3 Claims, 1 Drawing Figure

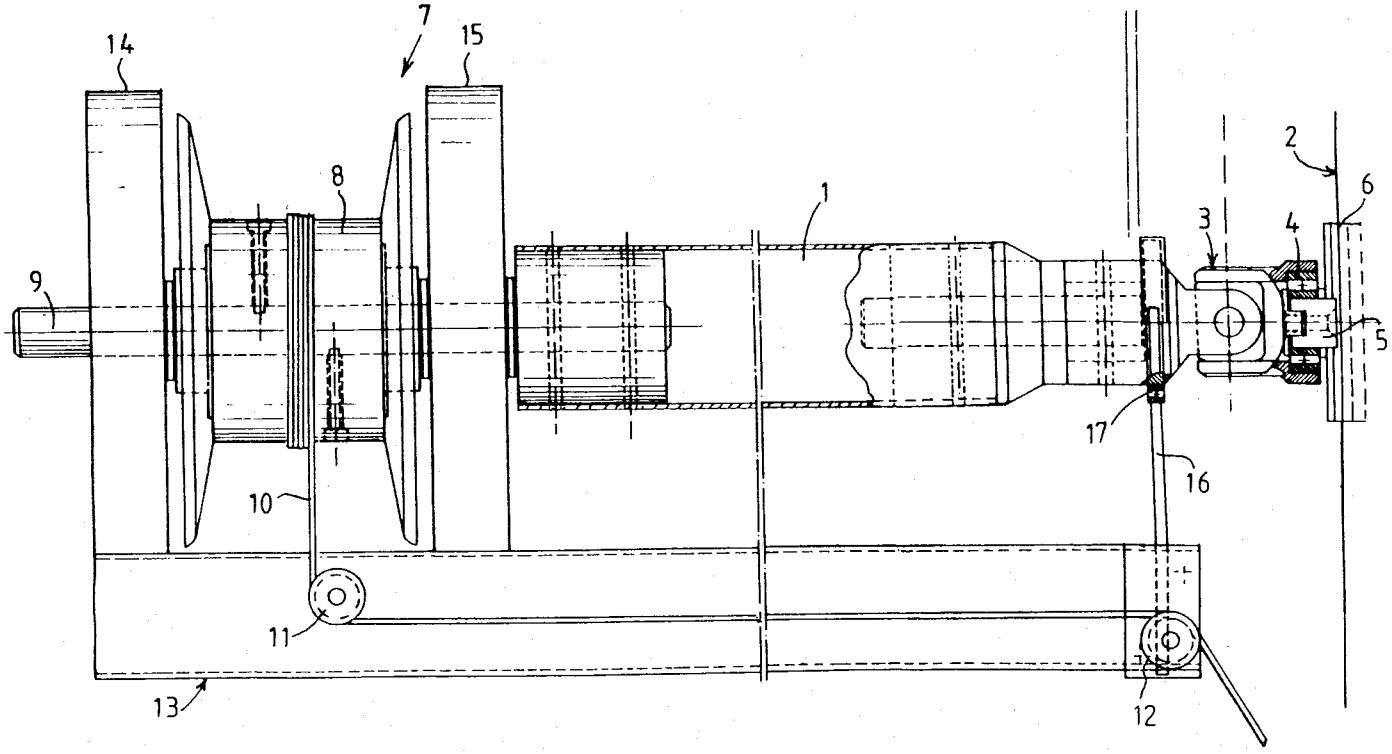
6
5
2
4
3
16
17
12
1
15
7
8
10
11
13
14
9

DEVICE FOR FURLING A SAIL OF A SHIP ON A BOOM

The present invention relates to devices for furling a sail of a ship on a boom.

In the state of the art a number of furling devices of this type are known in which the boom is in general connected to a mast by means of articulation means and is mounted so that it can rotate about itself. These devices also comprise means for driving the boom in rotation to furl the sail on the latter, the foot of the sail being fastened to the boom.

The rotational drive of the boom may be implemented in various ways. Thus, for example, a rotational motion may be imparted to the boom by means of a crank handle passing through the mast, a notched block interacting with a line operated from the steering station of the ship, or an endless-screw system.

However, all these devices have a number of disadvantages. In fact, in the case of a drive by means of a crank handle passing through the mast, the mast must be pierced through and this reduces its strength to a degree and is relatively costly. In the case of a drive by means of a notched block or by means of an endless-screw system, these driving means are placed close to the region where the boom is attached to the mast. Now, it is important that this region of attachment, near which the means for articulating the boom to the mast are also to be found, be as unencumbered as possible, in order to permit good furling of the sail onto the boom, especially when the sail is provided with a bolt rope interacting with a bolt rope tunnel extending along a generatrix of the mast.

From the document U.S. Pat. No. 3,285,215, there is also known a device for furling a sail on a boom, in which the means for driving the boom in rotation consist of a crank handle fastened to the end of the boom away from the articulation means.

Furthermore, there is also known, from the document U.S. Pat. No. 3,877,406, a sail furling/unfurling device comprising a drum driven by a line, one end of which is attached to the mast of the boat and the other end of which is attached to resilient return means. Since the luff of the sail is fastened to the mast, the aft end of the boom moves proportionately closer to the mast as the sail is furled on the boom.

It is understandable that such devices are extremely difficult to implement.

The purpose of the invention is therefore to solve the problems set out above.

To this end, the subject of the invention is a device for furling a sail of a ship on a boom connected to a mast by means of articulation means and mounted so that it can rotate about itself, the luff of the sail being mounted so that it can move in relation to the mast and this device comprising means for driving the boom in rotation in order to furl the sail on the latter, which means are arranged on the end of the boom away from the articulation means, characterized in that the said means for driving in rotation comprise a drum integally fastened to the boom and around which is arranged a line for driving the said drum and in that it comprises means for returning the line towards the steering station of the ship.

The invention will be understood better with the aid of the following description which is given solely by way of example and with reference to the attached drawing, which shows a furling device according to the invention.

As can be seen from this drawing, a boom 1 is connected to a mast 2 of a ship by means of articulation means 3 consisting, for example, of a universal joint articulation. This boom 1 is mounted so that it can rotate about itself by means of a bearing, for example a ball bearing 4 whose outer cage carries a corresponding part of the universal joint articulation 3 and whose inner cage is mounted on a supporting member 5 of a plate 6 fastened to the mast. The articulation means 3 and the boom 1 are thus fastened to the mast by means of this plate 6 which is made fast to the mast 2 by any known means, for example by means of screws or rivets.

The foot of a sail (not shown) is fastened to the boom by any known means, while its luff is fastened to the mast, for example by a bolt rope capable of sliding in a bolt rope tunnel forming an integral part of the mast.

At its end away from the articulation means, the boom 1 comprises means for being driven in rotation, indicated generally by the reference 7. These means for driving in rotation consist of a drum 8 fastened integrally to a shaft 9 which is itself integrally fastened to the boom 1. Around this drum 8 is arranged a line 10 for driving the latter.

The furling device according to the invention also comprises means for returning this line towards the steering station of the ship. These return means consist of blocks 11 and 12 arranged in a guiding conduit 13 extending along the boom, from the free end of the latter as far as its end which is connected to the means for articulating the boom to the mast.

It should be noted that the guiding conduit 13 is suspended so that it can oscillate relative to the boom 1, at each of its ends.

Thus, for example, the guiding conduit 13 may be integrally fastened, at one of its ends, to two flanges 14 and 15, arranged on each side of the drum 8 and mounted so that they can rotate in a manner which is known per se around the shaft 9. At its other end, the guiding conduit 13 may be suspended by means of at least one support rod 16 fastened integrally to the outer cage of a ball bearing 17 whose inner cage is integrally fastened to the boom.

It should be noted that the whole device may be housed in a sleeve designed for this purpose, that is to say comprising a slot for the sail to pass through and openings especially for the passage of the line connecting the drum to the steering station of the ship. This sleeve is then integrally fastened to the guiding conduit 13 so as to follow the movements of the latter around the boom.

When a pull is applied to the line 10, the drum 8 and the boom 1 are driven in rotation, thus causing the sail to furl around this boom 1. This pull may be applied manually, using known mechanical means.

Furthermore, the driving means may also comprise gearing reduction means of a known type which are connected to the boom, these means being driven, for example, by a handle or by an electric motor controlled, for example, from the steering station.

It is found that the region close to the point where the boom is fastened to the mast is unencumbered by any means for driving this boom, and this permits a substantial improvement in the furling of the sail on the latter and makes it possible to fasten more simply the boom, and more especially the means for articulating it, to the mast.

Downhaul and sheet tackle may be fastened in a manner known per se to the guiding conduit 13 so as to determine the position of the boom.

What is claimed is:

1. A device for furling a sail of a ship on a boom (1) connected at one end to a mast (2) by means of articulation means (3) and mounted so that it can rotate about itself, the luff of the sail being mounted so that it can move in relation to the mast and this device comprising means (7) for driving the boom in rotation in order to furl the sail on the boom, which means are arranged on the end of the boom (1) away from the articulation means (3), in which said means for driving in rotation comprise a drum (8) which is integrally fastened to the boom (1) and around which is arranged a line (10) for driving said drum and which device comprises means for returning (11, 12) the line towards the steering station of the ship;

wherein the said return means consist of at least two blocks (11, 12) arranged in a guiding conduit (13) extending along the boom, from the free end of the boom to said one end which is connected to the means for articulating the boom to the mast;

wherein the said guiding conduit (13) is suspended at each of its ends so that it can rotate around the longitudinal axis of the boom (1); and wherein the guiding conduit (13) is integrally fastened, at one of its ends, to at least one flange (14, 15) mounted for rotation relative to the boom (1), and, at the other end, to at least one support rod (16) fastened integrally to the outer cage of a bearing (17) whose inner cage is integrally fastened to the boom.

2. The device as claimed in claim 1 of the preceding claims, wherein the articulation means (3) are fastened to the mast by means of a plate (6).

3. The device as claimed in claim 2, wherein the said articulation means are mounted for rotation around a supporting member (5) of the plate (6) by means of a bearing (4).

* * * * *